US008565626B2

(12) United States Patent
Mizumo

(10) Patent No.: US 8,565,626 B2
(45) Date of Patent: Oct. 22, 2013

(54) IMAGE FORMING SYSTEM, CONTROL APPARATUS, AND IMAGE FORMING APPARATUS HAVING TONER TRANSFER RATES FOR FIRST AND SECOND FACES OF A RECORDING PAPER

(75) Inventor: Masahiro Mizumo, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 319 days.

(21) Appl. No.: 13/011,379

(22) Filed: Jan. 21, 2011

(65) Prior Publication Data

US 2011/0182592 A1 Jul. 28, 2011

(30) Foreign Application Priority Data

Jan. 22, 2010 (JP) ..... 2010-011576
Jan. 4, 2011 (JP) ..... 2011-000200

(51) Int. Cl.
*G03G 15/00* (2006.01)

(52) U.S. Cl.
USPC ..... 399/38; 399/384

(58) Field of Classification Search
USPC ..... 399/38, 45, 53–56, 67, 68, 381, 384, 399/389
See application file for complete search history.

(56) References Cited

U.S. PATENT DOCUMENTS 6,795,683 B2 * 9/2004 Nakazawa et al. ..... 399/384
7,552,995 B2 * 6/2009 Nakazawa et al. ..... 347/40

FOREIGN PATENT DOCUMENTS

JP 2005-115355 4/2005
JP 3668658 4/2005

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A control apparatus, connected to two image forming apparatuses each forming an image on one of a first face and a second face serving as image forming faces of a continuous recording paper, includes a receiving unit that receives, from each image forming apparatus, information regarding a transfer rate affecting condition that affects a difference in toner transfer rates of the image forming faces; a determining unit that determines, based on a standard amount of toner deposit and the transfer rate affecting condition regarding each of the first face and the second face, a target deposit amount representing a target amount of toner deposit in each of the two image forming apparatuses in such a way that the target deposit amounts have a difference corresponding to the difference in the toner transfer rate between the two image forming apparatuses.

17 Claims, 7 Drawing Sheets

IMAGE FORMING SYSTEM, CONTROL APPARATUS, AND IMAGE FORMING APPARATUS HAVING TONER TRANSFER RATES FOR FIRST AND SECOND FACES OF A RECORDING PAPER

CROSS-REFERENCE TO RELATED APPLICATIONS

The present application claims priority to and incorporates by reference the entire contents of Japanese Patent Application No. 2010-11576 filed in Japan on Jan. 22, 2010 and Japanese Patent Application No. 2011-000200 filed in Japan on Jan. 4, 2011.

BACKGROUND OF THE INVENTION

1. Field of the Invention

The present invention relates to an image forming system, a control apparatus, and an image forming apparatus.

2. Description of the Related Art

As a typical image forming apparatus forming toner images on both faces of a recording sheet such as a recording paper, a copying machine is disclosed in Japanese Patent Application Laid-open No. 2005-115355. In that copying machine, a single imaging unit operates to form a toner image to be transferred onto one face of a recording sheet and to form a toner image to be transferred onto the other face of the recording sheet. The imaging unit includes a photosensitive member functioning as an image carrying member, a charging unit that uniformly charges the photosensitive member, a latent image writing unit that writes a latent image on the uniformly charged photosensitive member by means of optical scanning, and a developing unit that develops the latent image formed on the photosensitive member. In the duplex mode of the copying machine in which a toner image is formed on each face of a recording sheet, a first toner image that has been formed by the imaging unit on the surface of the photosensitive member is transferred firstly onto a first intermediate transfer belt and then is further transferred onto a second intermediate transfer belt. Besides, at a slightly earlier timing than the timing of the second transferring operation, a second toner image is formed by the imaging unit on the surface of the photosensitive member. The second toner image is then transferred onto the first intermediate transfer belt. Subsequently, a recording sheet is fed to an area facing the first intermediate transfer belt and the second intermediate transfer belt. As the recording sheet passes over that area, the first toner image gets transferred from the second intermediate transfer belt onto one face of the recording sheet and the second toner image gets transferred from the first intermediate transfer belt onto the other face of the recording sheet.

In such a configuration, as compared to the second toner image, the first toner image is subjected to the transferring operation for one additional number of times. Hence, regarding the first toner image, the amount of toner loss occurring due to the residual toner left during the transferring operations is larger as compared to the second toner image. Thus, in case the first toner image and the second toner image are formed under the same imaging conditions (e.g., a latent image writing condition, a developing condition, etc.), then the image density in the first toner image falls below the image density in the second toner image. In regard to that issue, in the copying machine disclosed in Japanese Patent Application Laid-open No. 2005-115355, the imaging conditions for the first toner image and the imaging conditions for the second toner image are separately corrected in the following manner. Firstly, a first test toner image is formed on a recording sheet in the same way as the first toner image described above, while a second test toner image is formed on another recording sheet in the same way as the second toner image described above. Then, the user is prompted to perform the operation of separately setting the recording sheet with the first test toner image and the recording sheet with the second test toner image on a scanner to scan those test toner images. Once the image density of each test toner image is obtained by means of the operation, the imaging conditions for the first toner image and the imaging conditions for the second toner image are corrected so as to eliminate the difference in image densities of the two test toner images. As a result, the first toner image and the second toner image can be formed with substantially identical image densities.

Meanwhile, as an image forming apparatus forming toner images on both faces of a recording sheet, there is known a configuration in which a first imaging unit and a first transferring unit corresponding to one face of the recording sheet are disposed separately from a second imaging unit and a second transferring unit corresponding to the other face of the recording sheet. In that configuration, the toner image to be transferred onto one face of the recording sheet and the toner image to be transferred onto the other face of the recording sheet are simultaneously formed. Hence, as compared to the copying machine disclosed in Japanese Patent Application Laid-open No. 2005-115355 in which a single imaging unit forms the two toner images at different timings, it becomes possible to speed up the image forming operation. Besides, since the number of transferring operations required for transferring a toner image from the image carrying member onto the first face of a recording sheet can be kept identical to the number of transferring operations for transferring a toner image onto the second face, it becomes possible to eliminate the difference in image densities that may occur due to the difference in the number of transferring operations.

However, in this type of image forming apparatuses, there are times when a difference occurs in the image densities on the two faces of a recording sheet due to reasons other than the difference in the number of transferring operations.

For example, it is common that the first imaging unit and the second imaging unit have individual differences in the imaging capability. In such a case, even if exactly the same imaging conditions are set in each of the first imaging unit and the second imaging unit, there occurs a difference in the amount of toner deposit per unit area of toner images formed on the surface of the respective image carrying members. That difference causes a difference in the image density on the first face and the image density on the second face of a recording sheet.

Moreover, consider the case when the first transferring unit and the second transferring unit have different toner transfer rates. Then, even if it is assumed that the first imaging unit and the second imaging unit have no individual differences in the imaging capability and that the same amount of toner deposit is achieved on the respective image carrying members, there still occurs a difference in the image density on the first face and the image density on the second face of the recording sheet.

Regarding the issue of a difference occurring in the toner transfer rates of the first transferring unit and the second transferring unit, one reason could be the implementation of a configuration in which fixing of a toner image is performed individually on each face of a recording sheet. In such a configuration, the inventor(s) of the present invention found by experiment that the toner transfer rates of the first transferring unit and the second transferring unit tend to differ by a large margin. More particularly, as common practice, only after a recording sheet has passed through the first transferring unit that transfers a toner image on one face of the recording sheet and has passed through the second transferring unit that transfers a toner image on the other face of the recording sheet, both faces of that recording sheet are simultaneously subjected to the fixing operation. However, depending on the apparatus configuration, while a recording sheet having passed through only one of the two transferring units and having an unfixed toner image formed on only one face thereof is being conveyed for the subsequent operation, there are times when the unfixed toner image is disrupted. To solve that problem, a configuration is sometimes implemented in which fixing of a toner image is performed individually on each face of the recording sheet. However, in such a configuration, the inventor(s) of the present invention found by experiment that, when a recording sheet gets heated by a fixing unit before entering a transferring unit at the downstream side, water evaporation that accompanies the heating leads to the formation of small wrinkles on the surface of the recording sheet thereby reducing the toner transferability during the toner transferring operation performed by the transferring unit at the downstream side. Once the toner transferability is reduced; then, irrespective of whether a substantially identical amount of toner is deposited on the toner images formed on a first image carrying member and a second image carrying member, there occurs a difference in the image density on the first face and the image density on the second face of the recording sheet.

Regarding the issue of a difference occurring in the toner transfer rates of the first transferring unit and the second transferring unit, another reason could be the implementation of a configuration in which the toner concentration is decreased with an increase in the cumulative usage time of the magnetic carrier. More particularly, as the cumulative usage time of the developer carrier contained in a developing unit goes on increasing, the developer carrier goes on losing its toner adsorption capability. Hence, a scumming effect tends to occur in the toner image by which the toner gets deposited on the non-image portion as well. In order to prevent the scumming effect from occurring, there are times when a configuration is implemented in which the toner concentration is decreased with an increase in the cumulative usage time of the magnetic carrier. As the toner concentration decreases, the carrier particles and the toner particles undergo sliding friction in a more active manner thereby leading to an increase in the average toner charge. By extension, the toner adsorption capability of the developer carrier can be enhanced so as to prevent the scumming effect from occurring. However, an increase in the average toner charge results in an enhanced adsorption force between the toner and the image carrying member. That reduces the toner transferability during the toner transferring operation. For that reason, it was found that a large difference occurs in the image density on the first face and the image density on the second face of the recording sheet.

Therein, the inventor(s) of the present invention entertained the idea of implementing following configurations. Consider the case when the image densities on the two faces of a recording sheet differ from each other due to the fact that the number of transferring operations required for transferring a first toner image from the image carrying member onto one face of the recording sheet is different than the number of transferring operations required for transferring a second toner image onto the other face. That problem is eliminated by implementing a configuration in which a first imaging unit and a first transferring unit corresponding to one face of the recording sheet are disposed separately from a second imaging unit and a second transferring unit corresponding to the other face of the recording sheet. Further, consider the case when the image densities on the two faces of a recording sheet differ from each other due to the fact that there exists a large difference in the imaging capability of the first imaging unit and the imaging capability of the second imaging unit, and that there exists a large difference in the toner transfer rate of the first transferring unit and the toner transfer rate of the second transferring unit. That problem is eliminated by implementing a configuration in which, based on the difference in the image density of a toner image transferred onto the recording sheet by the first transferring unit and the image density of a toner image transferred onto the recording sheet by the second transferring unit, the imaging conditions for the first imaging unit and the imaging conditions for the second imaging unit are corrected so as to reduce the difference in image densities. With that, even if there exists a large difference in the imaging capability of the first imaging unit and the imaging capability of the second imaging unit or even if there exists a large difference in the toner transfer rate of the first transferring unit and the toner transfer rate of the second transferring unit, it becomes possible to reduce the difference in image densities on the two faces of the recording sheet. However, since it is imperative to form test toner images on the recording sheet, the user is forced to unintentionally consume the recording sheet.

SUMMARY OF THE INVENTION

It is an object of the present invention to at least partially solve the problems in the conventional technology.

According to an aspect of the present invention, there is provided an image forming system including: two image forming apparatuses, each forming an image on one of a first face and a second face serving as image forming faces of a continuous recording paper; and a control apparatus connected to the two image forming apparatuses. The control apparatus includes a receiving unit that receives, from each of the two image forming apparatuses, information regarding a transfer rate affecting condition that affects a difference in toner transfer rates of the image forming faces; a determining unit that determines, based on a standard amount of toner deposit and the transfer rate affecting condition regarding each of the first face and the second face, a target deposit amount representing a target amount of toner deposit in each of the two image forming apparatuses in such a way that the target deposit amounts have a difference corresponding to the difference in the toner transfer rate between the two image forming apparatuses; and a sending unit that sends the target deposit amounts to the two image forming apparatuses Each of the two image forming apparatuses includes a communicating unit that sends the corresponding transfer rate affecting condition to the control apparatus and receives the corresponding target deposit amount from the control apparatus; an imaging condition correcting unit that corrects an imaging condition based on the corresponding target deposit amount; and an image forming unit that forms an image based on the corrected imaging condition.

According to another aspect of the present invention, there is provided a control apparatus connected to two image forming apparatuses each forming an image on one of a first face and a second face serving as image forming faces of a continuous recording paper. The control apparatus includes: a receiving unit that receives, from each of the two image forming apparatuses, information regarding a transfer rate affecting condition that affects a difference in toner transfer rates of the image forming faces; a determining unit that determines, based on a standard amount of toner deposit and the transfer rate affecting condition regarding each of the first face and the second face, a target deposit amount representing a target amount of toner deposit in each of the two image forming apparatuses in such a way that the target deposit amounts have a difference corresponding to the difference in the toner transfer rate between the two image forming apparatuses; and a sending unit that sends the target deposit amounts to the two image forming apparatuses.

According to still another aspect of the present invention, there is provided an image forming apparatus that is connected to a control apparatus and that forms an image on a second face from among a first face and a second face serving as image forming faces of a continuous recording paper. The image forming apparatus includes: a sending unit that sends, to the control apparatus, a transfer rate affecting condition that affects a difference in toner transfer rates of the first face and the second face; a receiving unit that receives, from the control apparatus, a target deposit amount that is determined by the control apparatus based on a standard amount of toner deposit and the transfer rate affecting condition regarding each of the first face and the second face and that is determined as a target amount of toner deposit in the image forming apparatus and has a difference corresponding to the difference in the toner transfer rates in the image forming apparatus and another image forming apparatus that forms an image on the first face; an imaging condition correcting unit that corrects an imaging condition based on the target deposit amount; and an image forming unit that forms an image based on the corrected imaging condition.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of an image forming system, a control apparatus, and an image forming apparatus according to the present invention are described in detail below with reference to the accompanying drawings. The present invention is not limited to these exemplary embodiments.

First Embodiment

Figure 1:
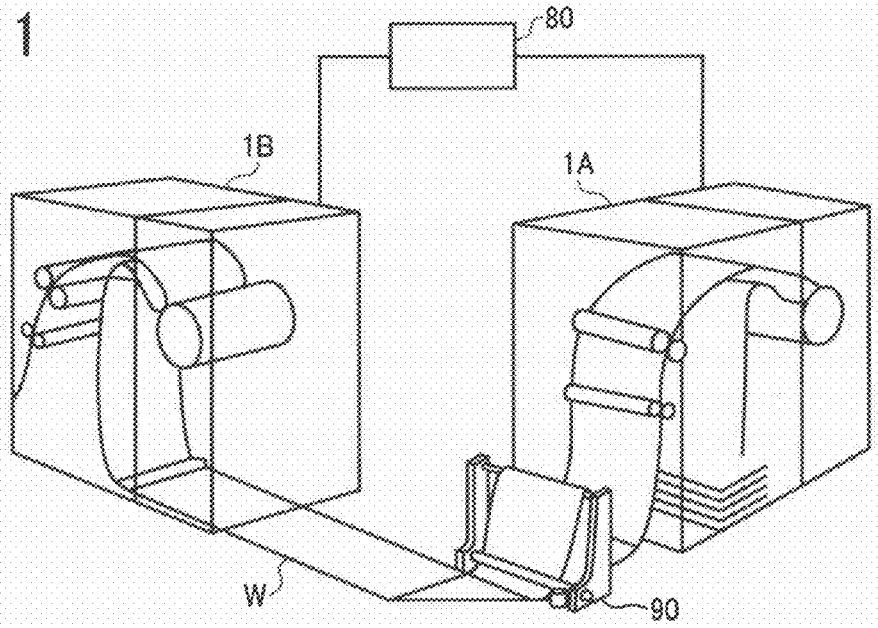
FIG. 1 is a schematic diagram of an overall configuration of an image forming system according to a first embodiment of the present invention.

FIG. 1 is a schematic diagram of an overall configuration of an image forming system according to a first embodiment of the present invention. The image forming system according to the present embodiment includes a first image forming apparatus 1A, a second image forming apparatus 1B, a communication apparatus 80 functioning as a control apparatus, and an inter-apparatus paper inverter 90. All of these constituent elements are separately configured.

The first image forming apparatus 1A and the second image forming apparatus 1B have an identical configuration, and are configured to form toner images on a web W that is a sheet of continuous recording paper.

Figure 2:
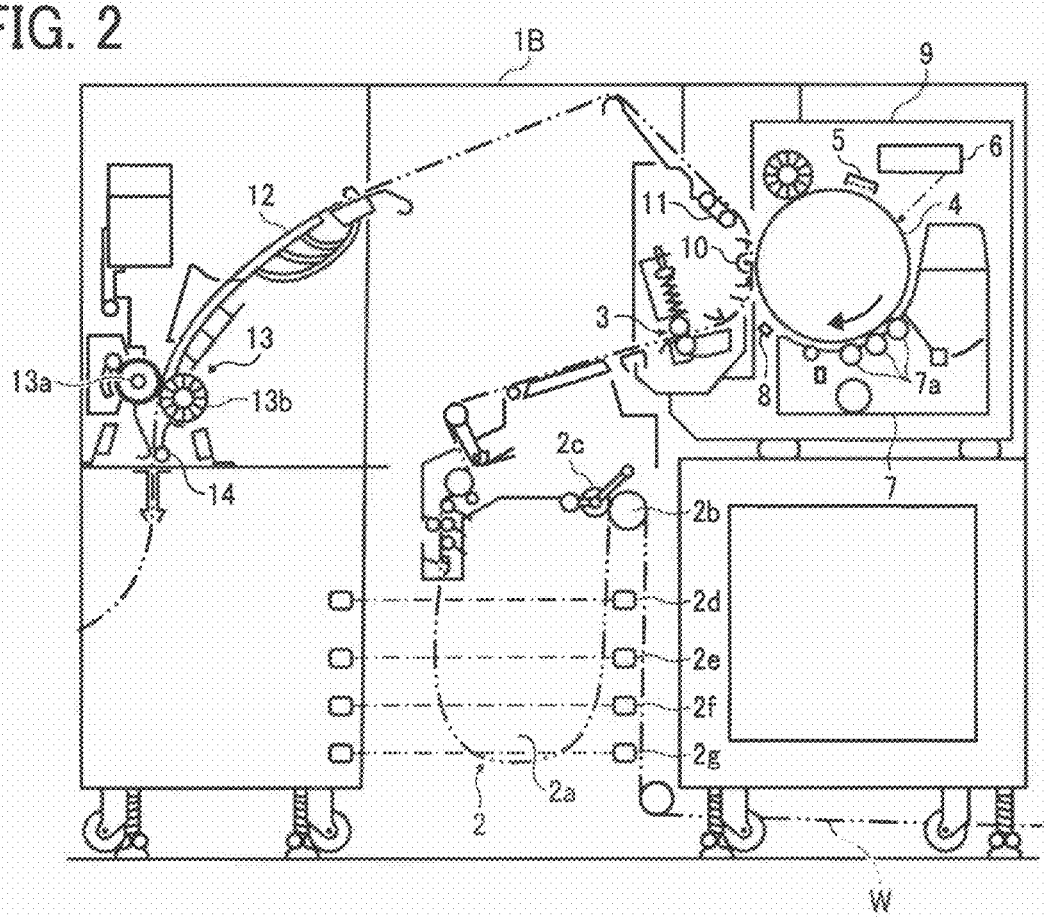
FIG. 2 illustrates a skeleton framework of a second image forming apparatus in the image forming system.

FIG. 2 illustrates a skeleton framework of the second image forming apparatus 1B, which includes a web buffer mechanism 2, a pair of paper conveying rollers 3, an imaging device 9, a transfer device 10, a paper conveying device 11, a preheater 12, a fixing device 13, and a discharging roller 14.

Upon being discharged by the first image forming apparatus 1A, the web W passes through the lower portion of the second image forming apparatus 1B and reaches the web buffer mechanism 2, which includes an accumulating unit 2*a* that temporarily accumulates the web W being conveyed, a pair of rollers 2*b* and 2*c* that are disposed on the upstream side in the web conveying direction relative to the accumulating unit 2*a*, and a plurality of sensors (in the present example, four pairs of optical sensors 2*d*, 2*e*, 2*f*, and 2*g*) that monitors the amount of slack (i.e., a buffer amount) of the web W occurring in the accumulating unit 2*a*.

Herein, the roller 2*b* is a driving roller having a drive source (not illustrated), while the roller 2*c* is a driven roller not having any drive source. Besides, the roller 2*c* is equipped with an adjusting mechanism that adjusts the pressing force of the roller 2*c* against the roller 2*b*. Upon passing through a web discharging portion of the accumulating unit 2*a*, the web W enters a conveying nip formed between the pair of paper conveying rollers 3. Upon getting sandwiched in the conveying nip formed by the mutual abutment of the pair of paper conveying rollers 3, the web W is then conveyed to the imaging device 9 by the rotary-driving of the paper conveying rollers 3.

The imaging device 9 includes a photosensitive member 4, a charging unit 5, an optical writing unit 6, a developing unit 7, and a toner deposit amount sensor 8. The surface of the photosensitive member 4 that is rotary-driven in the clockwise direction is uniformly charged by the charging unit 5. In the present embodiment, the charging unit 5 charges the photosensitive member 4 to positive polarity, which is also the polarity to which the toner is charged.

On the surface of the photosensitive member 4 that has been uniformly charged by the charging unit 5, the optical writing unit 6 emits a laser light for performing optical scanning. With respect to the photosensitive member 4, the optical writing unit 6 refers to image information received from an outside personal computer or the like (not illustrated) and accordingly performs optical scanning by driving laser diodes. Of the entire area on the uniformly-charged surface of the photosensitive member 4, the portions exposed to the laser light undergo potential decay. That results in the formation of an electrostatic latent image on the surface of the photosensitive member 4.

The electrostatic latent image is then developed into a toner image by the developing unit 7, which contains a developer (not illustrated) made of toner powder and a magnetic carrier. The developer is carried on three developing rollers 7*a* and forms a magnetic brush on the surface of each developing roller 7*a* due to the magnetic force of a magnet roller (not illustrated) included therein. The developer forming the magnetic brush is rubbed against the surface of the photosensitive member 4. While the rubbing takes place, due to the developing potential generated because of the potential difference between the developing bias applied to the developing rollers 7*a* and the potential of the electrostatic latent image formed on the photosensitive member 4, the toner inside the developer escapes from the surface of the magnetic carrier and gets transferred onto the electrostatic latent image formed on the photosensitive member 4. As a result, the electrostatic latent image gets developed into a toner image.

While the developing is carried out, the toner concentration in the developer decreases. In the developing unit 7, the toner concentration in the developer is detected using a toner concentration sensor such as a magnetic permeability sensor. The detection result is referred to at the time of drive-controlling a toner filling device (not illustrated). More particularly, in order to bring the detection result output by the toner concentration sensor in line with a predetermined target toner concentration, the toner filling device is driven at a suitable timing and for a suitable driving period so as to feed an appropriate quantity of toner to the developing unit 7. By performing such control for toner feed, the toner concentration in the developer inside the developing unit 7 can be maintained in the neighborhood of the predetermined target toner concentration.

The web W that has been conveyed by the pair of paper conveying rollers 3 toward the imaging device 9 enters a transfer nip that is formed between the transfer device 10 and that portion in the circumferential direction of the photosensitive member 4 which lies immediately after the position opposite to the developing unit 7. In the transfer nip, a transfer electric field gets formed between the transfer device 10 and the electrostatic latent image formed on the photosensitive member 4. The transfer electric field acts to electrostatically transfer the toner from a photosensitive member to a transfer device. Consequently, the toner image formed on the photosensitive member 4 gets electrostatically transferred onto the surface of the web W.

Once the web W having the toner image electrostatically transferred thereon is discharged from the transfer nip, the paper conveying device 11 conveys the web W inside the preheater 12, which then preheats the web W by means of, e.g., radiation before the web W enters the fixing device 13 described later. With the preheating process, the web W is heated up to a temperature that is slightly lower than the glass-transition point of the toner resin.

Upon passing through the preheater 12, the web W reaches the fixing device 13, which includes a fixing nip formed by the abutment of a fixing roller 13*a* with an in-built heat source such as a halogen lamp and a pressure roller 13*b* that is pressed toward the fixing roller 13*a*. The fixing device 13 sandwiches the web W in the fixing nip in such a way that the surface of the web W having the toner transferred thereon makes contact with the fixing roller 13*a*. As a result, the web W gets heated under pressure. Due to the heating under pressure, the toner in the toner image formed on the web W melts and gets fixed to the paper. Subsequently, the web W that has passed through the fixing device 13 is discharged by the discharging roller 14 to the outside of the second image forming apparatus 1B.

Herein, although the detailed explanation is given regarding the second image forming apparatus 1B, the first image forming apparatus 1A illustrated in FIG. 1 also has the same configuration and forms toner images on the web W in an identical manner. Depending on the user settings or depending on the control signals sent by the communication apparatus 80, the first image forming apparatus 1A and the second image forming apparatus 1B perform the image forming operation either in a mutually independent manner or in conjunction with each other.

For example, in the case when the demand is high for the single-side printing mode in which toner images are formed on only one face of the web W, the user can use the first image forming apparatus 1A and the second image forming apparatus 1B to independently perform the single-side printing operation. Hence, in the first image forming apparatus 1A and the second image forming apparatus 1B, the user separately sets the web W that has been placed on the respective web buffer mechanisms 2. Besides, the user sends the image information separately to each image forming apparatus.

On the other hand, in the case when the demand is high for the duplex printing mode in which toner images are formed on both faces of the web W, the user can use the first image forming apparatus 1A and the second image forming apparatus 1B in conjunction to perform the duplex printing operation. More particularly, firstly, one of the first image forming apparatus 1A and the second image forming apparatus 1B is used to form a toner image on a first face of the web W, and then the other image forming apparatus is used to form a toner image on a second face of the web W. Herein, since either one of the first image forming apparatus 1A and the second image forming apparatus 1B can be used for printing on the first face of the web W, it is up to the user to determine which image forming apparatus would print on the first face. However, as far as the communication apparatus 80 is concerned, it is necessary to ensure that the communication apparatus 80 knows which of the first image forming apparatus 1A and the second image forming apparatus 1B would print on the first face of the web W. This is because, in the duplex printing mode, when the user sends, to the communication apparatus 80, the image information meant for the first-face-printing as well as the image information meant for the second-face-printing, the communication apparatus 80 should send the image information meant for the first-face-printing to one of the forming apparatus determined to be used for printing on the first face, and send the image information meant for the second-face-printing to one of the forming apparatus determined to be used for printing on the second face.

Prior to carrying out duplex printing, the user performs the following settings. The user pulls out the web W that has been placed on the web buffer mechanism 2 of that image forming apparatus which is selected for printing on the first face and then sets the web W in that particular image forming apparatus. Subsequently, the user presses a paper feed button of that image forming apparatus so that the blank web W set therein is discharged from the image forming apparatus. Then, the user runs the leading end of the discharged web W in the inter-apparatus paper inverter 90 illustrated in FIG. 1 so as to invert the front and rear faces of the web W, and sets the inverted web W in the other image forming apparatus which is selected for printing on the second face. In this way, the web W discharged by the first-face-printing image forming apparatus gets inverted and is then received in the second-face-printing image forming apparatus.

After performing such settings, the user sends the image information for the duplex printing mode to the communication apparatus 80, which then sends a paper-feed start command signal to both image forming apparatuses at about the same time so as to instruct each image forming apparatus to start the paper feeding operation. Subsequently, the communication apparatus 80 sends a reference timing signal for first face and the image information for first face to the first-face-printing image forming apparatus, as well as sends a reference timing signal for second face and the image information for second face to the second-face-printing image forming apparatus. Based on the reference timing signal for first face, the first-face-printing image forming apparatus forms a toner image on the first face of the web W. Then, in due time, the toner image formation area in the longitudinal direction of the web W on the first face gets discharged from the first-face-printing image forming apparatus, and passes through the inter-apparatus paper inverter 90 before entering the second-face-printing image forming apparatus. At that time, based on the reference timing signal for second face that is received from the communication apparatus 80, the second-face-printing image forming apparatus starts the imaging operation with respect to the web W so that the toner image formation area in the longitudinal direction on the second face of the web W exactly synchronizes with the toner image formation area on the first face. Hence, the toner image formation area on the first face and the toner image formation area on the second face are adjusted to each other.

The inventor(s) of the present invention found by experiment that the image forming system with the abovementioned configuration suffers from the following failures. The web W to be subjected to printing in the second-face-printing image forming apparatus (i.e., the second image forming apparatus 1B in the example illustrated in FIG. 1) is already heated by the preheater 12 and the fixing device 13 disposed in the first-face-printing image forming apparatus (i.e., the first image forming apparatus 1A in the example illustrated in FIG. 1). At that time, small wrinkles are formed on the surface of the web W due to water evaporation that accompanies the heating. Although those small wrinkles are barely noticeable to the naked eye, they greatly affect the toner transferability during the toner transferring operation performed at a latter stage. More particularly, in the second-face-printing image forming apparatus, the small wrinkles cause a decline in the adhesion between the surface of the web W and the surface of the photosensitive member 4, and thus the toner transferability declines as compared to when no wrinkles are formed. As a result, as compared to the toner image formed on the first face of the web W, the toner image formed on the second face is prone to have a lighter image density.

Explained below is the distinguishing configuration of the image forming system according to the embodiment.

As illustrated in FIG. 2, in the image forming system according to the embodiment, in the imaging device 9 of the second image forming apparatus 1B is disposed the toner deposit amount sensor 8, which performs detection with respect to the surface of the photosensitive member 4 moving between the developing unit 7 and the transfer device 10. The first image forming apparatus 1A also has an identical toner deposit amount sensor disposed therein. Each toner deposit amount sensor is a reflective photosensor configured to output a voltage corresponding to the amount of toner deposit per unit area of the toner image formed on the surface of the corresponding photosensitive member 4.

Each of the first image forming apparatus 1A and the second image forming apparatus 1B include a control unit (not illustrated) that drive-controls the constituent elements and that is configured from a central processing unit (CPU), a random access memory (RAM), and a read only memory (ROM), etc. Each control unit is configured to perform an imaging condition correcting operation at predetermined timings with the aim of correcting the imaging conditions such as the developing potential or as the toner concentration (target) of the developer.

Figure 3:
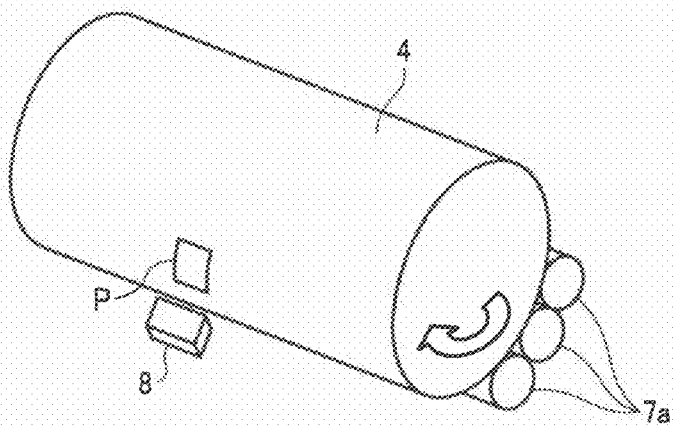
FIG. 3 is an enlarged perspective view of a photosensitive member and a configuration surrounding the photosensitive member in each image forming apparatus.

In the imaging condition correcting operation, the imaging conditions are corrected as explained below. Firstly, a predetermined test pattern image is formed on the surface of the photosensitive member 4. The test pattern image includes a plurality of patch-like toner images P as illustrated in FIG. 3, and each patch-like toner image P is formed under a different developing potential condition. With respect to each patch-like toner image P, the control unit refers to the voltage output by the corresponding toner deposit amount sensor 8 and figures out the amount of toner deposit. Subsequently, based on the amount of toner deposit and the developing potential in each patch-like toner image P, the control unit calculates a function (e.g., a regression line function) representing the relation therebetween and makes use of that function to identify such a developing potential that enables achieving a target amount of toner deposit that has been set in advance. Then, the control unit updates data of the developing potential at the time of imaging, which is stored in the RAM or the like, with the newly-identified developing potential. When the user instructs an image forming operation, the control unit ensures that the imaging is done under the condition of generating the developing potential same as that in the updated developing potential data. By performing such an imaging condition correcting operation, the toner stably equivalent to the target amount of toner deposit can be deposited on a toner image irrespective of any environmental changes.

Herein, the imaging condition correcting operation is performed by calculating the function representing the relation between the amount of toner deposit and the corresponding developing potential based on the amounts of toner deposit and the corresponding developing potentials in the patch-like toner images P obtained by developing process with different developing potentials. However, alternatively, it is also possible to perform the operation without calculating such a function. For example, from among the plurality of patch-like toner images P, the patch-like toner image P having the amount of toner deposit closest to the target amount of toner deposit is identified and the developing potential used at the time of imaging that particular patch-like toner image P is used for updating the developing potential data.

Meanwhile, although the explanation is given for the case of correcting the developing potential as the imaging condition to be corrected, it is also possible to correct other imaging conditions along with or instead of the developing potential. For example, it is also possible to correct the toner concentration of the developer. However, in a modification example described later, it is necessary to ensure that the imaging conditions other than the toner concentration are corrected. That is because, in the configuration in the modification example, the target toner concentration is reduced over time so as to prevent the occurrence of the scumming effect, which otherwise becomes conspicuous with time. Hence, in the modification example, it is not allowed to freely alter the target toner concentration.

In the first image forming apparatus 1A or the second image forming apparatus 1B, performing the imaging condition correcting operation makes it possible to stably form a toner image having the target amount of toner deposit on the surface of the photosensitive member 4 irrespective of environmental changes. However, during the duplex printing mode, as compared to the toner transferability in the first-face-printing image forming apparatus, the toner transferability in the second-face-printing image forming apparatus declines due to the fact that the web W, which has been subjected to heating, is used for printing. For that reason, even if the target amount of toner deposit is transferred onto the photosensitive member 4 in both image forming apparatuses, the amount of transferred toner may sometime fall short in the toner image formed on the second face. That may lead to an insufficient image density in the toner image formed on the second face.

In order to prevent the problem of insufficient image density from occurring, the inventor(s) entertained the idea of setting in advance a higher target amount of toner deposit for the second-face-printing image forming apparatus than the target amount of toner deposit set for the first-face-printing image forming apparatus. However, as described above, since it is up to the user to determine which of the two image forming apparatuses (1A and 1B) would do printing on the first face, it is not possible to set a higher target amount of toner deposit for one of the two image forming apparatuses.

Moreover, the inventor(s) also entertained the idea of configuring the toner deposit amount sensor 8 to perform detection with respect to a test pattern image transferred onto the web W instead of a test pattern image formed on the surface of the photosensitive member 4. That is because, it was thought that by referring to the eventual amount of toner deposit on the web W, it would be possible to set the eventual amount of toner deposit on the first face and on the second face to the target amount of toner deposit. However, in such a configuration, since it becomes necessary to perform the operation of transferring the test pattern image on the web W, the user is forced to unintentionally consume the sheet.

Figure 4:
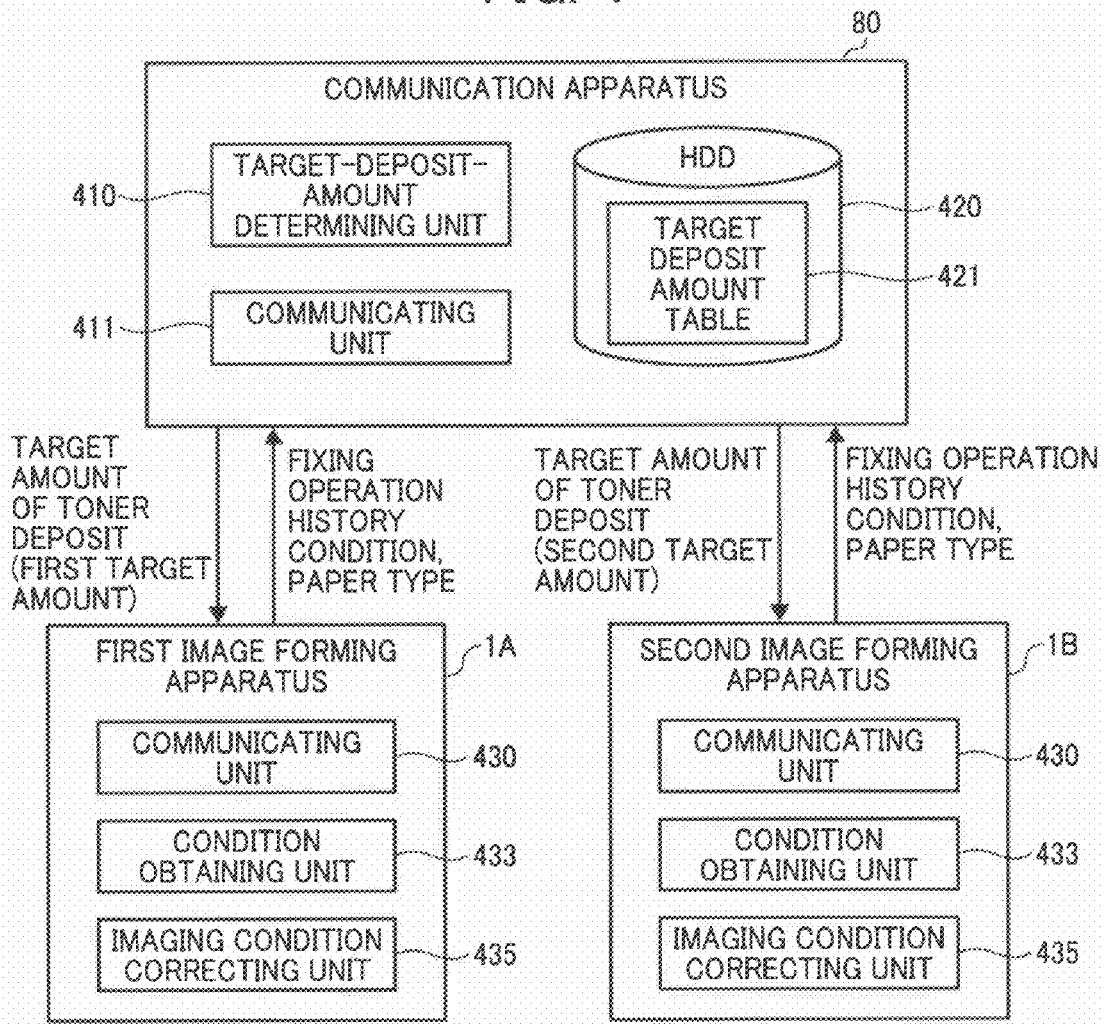
FIG. 4 is a block diagram of a functional configuration of the image forming system according to the first embodiment.

Taking into consideration such issues, the image forming system according to the first embodiment is configured as explained below. FIG. 4 is a block diagram of a functional configuration of the image forming system according to the first embodiment. In the embodiment, for printing in the duplex printing mode, it is assumed that the first image forming apparatus 1A prints on the front face of the web and the second image forming apparatus 1B prints on the rear face of the web.

As illustrated in FIG. 4, the communication apparatus 80 mainly includes a communicating unit 411 that functions as a receiving unit and a sending unit, includes a target-deposit-amount determining unit 410 that functions as a determining unit, and includes a hard disk drive (HDD) 420.

The communicating unit 411 receives, from each of the first image forming apparatus 1A and the second image forming apparatus 1B, the information regarding a transfer rate affecting condition and regarding the paper type of the web used in the first image forming apparatus 1A and the second image forming apparatus 1B. Besides, to the first image forming apparatus 1A, the communication unit 411 sends a first target amount that is the target amount of toner deposit determined for the first image forming apparatus 1A by the target-deposit-amount determining unit 410; and to the second image forming apparatus 1B, the communication unit 411 sends a first target amount that is the target amount of toner deposit determined for the second image forming apparatus 1B by the target-deposit-amount determining unit 410.

Herein, the transfer rate affecting condition is different than a transfer condition such as the transfer bias. Besides, the transfer rate affecting condition affects the difference between the toner transfer rate in the transfer device 10 in the first image forming apparatus 1A and the toner transfer rate in the transfer device 10 in the second image forming apparatus 1B. In the first embodiment, a fixing operation history condition is used as the transfer rate affecting condition. The fixing operation history condition indicates whether the web W is a "sheet having fixing history" that represents a sheet which has been subjected to the fixing operation at a prior stage or whether the web W is a "sheet having no fixing history" that represents a sheet which is not yet subjected to the fixing operation.

Based on the standard amount of toner deposit for the front face of the web, the standard amount of toner deposit for the rear face of the web, and the fixing operation history condition; the target-deposit-amount determining unit 410 determines the target amount of toner deposit for the first image forming apparatus 1A and the target amount of toner deposit for the second image forming apparatus 1B in such a way that those target amounts of toner deposit have a difference corresponding to the difference in the toner transfer rates in the first image forming apparatus 1A and the second image forming apparatus 1B.

More particularly, the target-deposit-amount determining unit 410 determines that the first image forming apparatus 1A that has sent the fixing operation history condition indicating a "sheet having no fixing history" would print on the front face (first face) of the web, and sets the target amount of toner deposit (first target amount) for the first image forming apparatus 1A to the standard amount of toner deposit. Similarly, the target-deposit-amount determining unit 410 determines that the second image forming apparatus 1B that has sent the fixing operation history condition indicating a "sheet having fixing history" would print on the rear face (second face) of the web, and sets the target amount of toner deposit (second target amount) for the second image forming apparatus 1B to an increased amount of the standard amount of toner deposit that is increased based on the toner transfer rate depending on the paper type.

Meanwhile, as illustrated in FIG. 4, each of the first image forming apparatus 1A and the second image forming apparatus 1B includes a communicating unit 430, a condition obtaining unit 433, and an imaging condition correcting unit 435.

The condition obtaining unit 433 obtains the information, which is stored in, e.g., a memory by input operation of user, about whether to print on the front face or on the rear face and the paper type of the web to be used for printing, from the memory. Then, the condition obtaining unit 433 sends the fixing operation history condition and the paper type to the communicating unit 430.

More particularly, as described above, under the condition set for duplex printing (i.e., when the web is set to pass through the both image forming apparatuses), the communication apparatus 80 is configured in such a way that the duplex printing operation is not performed unless information indicating which of the two image forming apparatuses (1A and 1B) is selected for printing on the first face is received from the user. Herein, the information indicating which image forming apparatus is selected for printing on the first face indirectly suggests that a "sheet having fixing history" is to be fed to the unselected image forming apparatus during the duplex printing operation. Therein, the condition obtaining unit 433 obtains that information as the information regarding the fixing operation history condition.

Meanwhile, while printing on the front face, the condition obtaining unit 433 sends the fixing operation history condition indicating a "sheet having no fixing history" to the communicating unit 430; while in the case of printing the rear face, the condition obtaining unit 433 sends the fixing operation history condition indicating a "sheet having fixing history" to the communicating unit 430.

Then, the communicating unit 430 sends the fixing operation history condition to the communication apparatus 80, and receives the target amount of toner deposit from the communication apparatus 80.

Based on the target amount of toner deposit, the imaging condition correcting unit 435 corrects the imaging conditions. The details regarding correction of imaging conditions are described above.

Explained below are the details of the target-deposit-amount determining unit 410 of the communication apparatus 80. From among the first target amount of toner deposit for a toner image formed on the photosensitive member 4 of the first-face-printing image forming apparatus and the second target amount of toner deposit for a toner image formed on the photosensitive member 4 of the second-face-printing image forming apparatus, at least one target amount of toner deposit is corrected in such a way that the two target amounts of toner deposit have a difference corresponding to the difference in the toner transfer rates in the respective image forming apparatuses. Such correction is performed based on the information on the fixing operation history condition that is set as the transfer rate affecting condition. More particularly, the fixing operation history condition bears a certain relationship with a "deposit amount difference" that represents the difference in an appropriate amount of toner deposit (on the photosensitive member 4) that can balance out the difference in image densities on the web W, which is attributed to the difference in the toner transfer rates (i.e., difference between the first face and the second face) occurring due to the fixing operation history condition. That relationship can be identified by prior experiment, and is stored in advance as a target deposit amount table 421 in the HDD 420. An example of the target deposit amount table 421 is illustrated in Table 1 given below.

TABLE 1

| | First image forming apparatus 1A | | | | Second image forming apparatus 1B | | | |
|---|---|---|---|---|---|---|---|---|
| No. | Usage mode | Paper type | Toner transfer rate | First target amount of toner deposit | Usage mode | Paper type | Toner transfer rate | Second target amount of toner deposit |
| 1 | Single-side printing | α | t | Tg | Single-side printing | α | T | Tg |
| 2 | First face during duplex printing | | t | Tg | First face during duplex printing | | T | Tg |
| 3 | Second face during duplex printing | | t − 5 | Tg × t/(t − 5) | Second face during duplex printing | | t − 5 | Tg × t/(t − 5) |
| 4 | Single-side printing | β | t | Tg | Single-side printing | β | T | Tg |
| 5 | First face during duplex printing | | t | Tg | First face during duplex printing | | T | Tg |
| 6 | Second face during duplex printing | | t − 10 | Tg × t/(t − 10) | Second face during duplex printing | | t − 10 | Tg × t/(t − 10) |

In Table 1, "single-side printing" indicates the single-side printing mode, which not only includes the setting when each of the two image forming apparatuses (1A and 1B) is instructed to form an image on a single face of the web W placed on the corresponding web buffer mechanism 2, but also includes the case when single-side printing is instructed under the setting for the duplex printing mode. More particularly, in the image forming system according to the embodiment, even when the setting is done for the duplex printing mode, it is possible to carry out single-side printing. That is, even when the setting is done for the duplex printing mode, single-side printing can be carried out by operating the imaging device 9 of only one of the two image forming apparatuses. Regarding which of the two imaging devices 9 is to be operated, it is up to the user to select and input the same in the communication apparatus 80. If the user selects the imaging device 9 of the first-face-printing image forming apparatus, then the imaging device 9 as well as the preheater 12 and the fixing device 13 of the corresponding image forming apparatus are stopped from operating. Similarly, if the user selects the imaging device 9 of the second-face-printing image forming apparatus, then the imaging device 9 as well as the preheater 12 and the fixing device 13 of the corresponding image forming apparatus are stopped from operating. Thus, in such a configuration, irrespective of which of the two image forming apparatuses is selected for performing single-side printing under the setting for the duplex printing mode, the fixing operation can be performed by using only the selected image forming apparatus. That makes it possible to prevent the web W from being unnecessarily subjected to the fixing operation.

In the image forming system according to the first embodiment, it has become clear by prior experiment that, when a paper type α is used as the web W, a difference in the toner transfer rates occurs between the web W having been subjected to the fixing operation and the web W not yet subjected to the fixing operation. For the toner transfer rate (i.e., for the ratio of a post-transfer toner amount to a pre-transfer toner amount) of t[%] with respect to the web W not yet subjected to the fixing operation, the toner transfer rate with respect to the web W having been subjected to the fixing operation becomes t−5[%]. In this case, the toner transfer amount with respect to the web W having been subjected to the fixing operation falls to be equal to the toner transfer amount of (t−5)/t[%] with respect to the web W not yet subjected to the fixing operation. Because of that, it is likely that a difference occurs between the image density of the first face and the image density of the second face of the web W.

Similarly, in the image forming system according to the first embodiment, it has become clear by prior experiment that, when a paper type β is used as the web W, a difference in the toner transfer rates occurs between the web W having been subjected to the fixing operation and the web W not yet subjected to the fixing operation. For the toner transfer rate (i.e., for the ratio of a post-transfer toner amount to a pre-transfer toner amount) of t[%] with respect to the web W not yet subjected to the fixing operation, the toner transfer rate with respect to the web W having been subjected to the fixing operation becomes t−10[%]. In this case, the toner transfer amount with respect to the web W having been subjected to the fixing operation decreases by a greater extent as compared to the paper type α and becomes equal to the toner transfer amount of (t−10)/t[%] with respect to the web W not yet subjected to the fixing operation. Because of that, it is likely that a large difference occurs between the image density of the first face and the image density of the second face of the web W.

In this way, when duplex printing is performed, from among the two image forming apparatuses (1A and 1B), the toner transfer rate in the second-face-printing image forming apparatus (i.e., the image forming apparatus installed at the downstream side) falls below the toner transfer rate t[%] of the first-face-printing image forming apparatus. As described above, for the paper type α, the toner transfer rate in the second-face-printing image forming apparatus falls to t−5 [%]; while for the paper type β, the toner transfer rate in the second-face-printing image forming apparatus falls to t−10 [%]. Therein, in the duplex printing mode, the communication apparatus 80 corrects the target amount of toner deposit in the second-face-printing image forming apparatus (i.e., corrects the first target amount when the first image forming apparatus 1A is the second-face-printing image forming apparatus, and corrects the second target amount when the second image forming apparatus 1B is the second-face-printing image forming apparatus) in the following manner. In the case of using the web W of the paper type α, to the first-face-printing image forming apparatus using a "sheet having no fixing history", the communication apparatus 80 sends a standard and uncorrected target deposit amount Tg as the target amount of toner deposit for the toner image formed on the corresponding photosensitive member 4. Based on that standard target deposit amount Tg, the first-face-printing image forming apparatus carries out the imaging condition correcting operation. On the other hand, to the second-face-printing image forming apparatus using a "sheet having fixing history", the communication apparatus 80 sends, as the target amount of toner deposit for the toner image formed on the corresponding photosensitive member 4, an amount obtained by multiplying the standard target deposit amount Tg with "t/(t−5)", which is the reciprocal of "(t−5)/t" in the toner transfer rate. As a result, the amount of decrease in the corresponding toner transfer rate, which is caused by the small wrinkles forming on the paper surface during the fixing operation, is balanced out by the amount of increase in the target amount of toner deposit on the corresponding photosensitive member 4. Subsequently, the second-face-printing image forming apparatus corrects the imaging conditions in the imaging condition correcting operation in such a way that the target amount of toner deposit $Tg \times t/(t-5)$ mg/cm$^2$ is achieved on the corresponding photosensitive member 4. As a result, on the first face and the second face of the web W of the paper type α, the post-paper-transfer amount of toner deposit becomes substantially identical.

Moreover, in the case of using the web W of the paper type β, to the first-face-printing image forming apparatus using a "sheet having no fixing history", the communication apparatus 80 sends the standard and uncorrected target deposit amount Tg as the target amount of toner deposit for the toner image formed on the corresponding photosensitive member 4. Based on the standard target deposit amount Tg, the first-face-printing image forming apparatus carries out the imaging condition correcting operation. On the other hand, to the second-face-printing image forming apparatus using a "sheet having fixing history", the communication apparatus 80 sends, as the target amount of toner deposit for the toner image formed on the corresponding photosensitive member 4, an amount obtained by multiplying the standard target deposit amount Tg with "t/(t−10)", which is the reciprocal of "(t−10)/t" in the toner transfer rate. As a result, the amount of decrease in the corresponding toner transfer rate, which is caused by the small wrinkles forming on the paper surface during the fixing operation, is balanced out by the amount of increase in the target amount of toner deposit on the corresponding photosensitive member 4. Subsequently, the second-face-printing image forming apparatus corrects the imaging conditions in the imaging condition correcting operation in such a way that the target amount of toner deposit $Tg \times t/(t-10)$ mg/cm$^2$ is achieved on the corresponding photosensitive member 4. As a result, on the first face and the second face of the web W of the paper type β, the post-paper-transfer amount of toner deposit becomes substantially identical.

Figure 5:
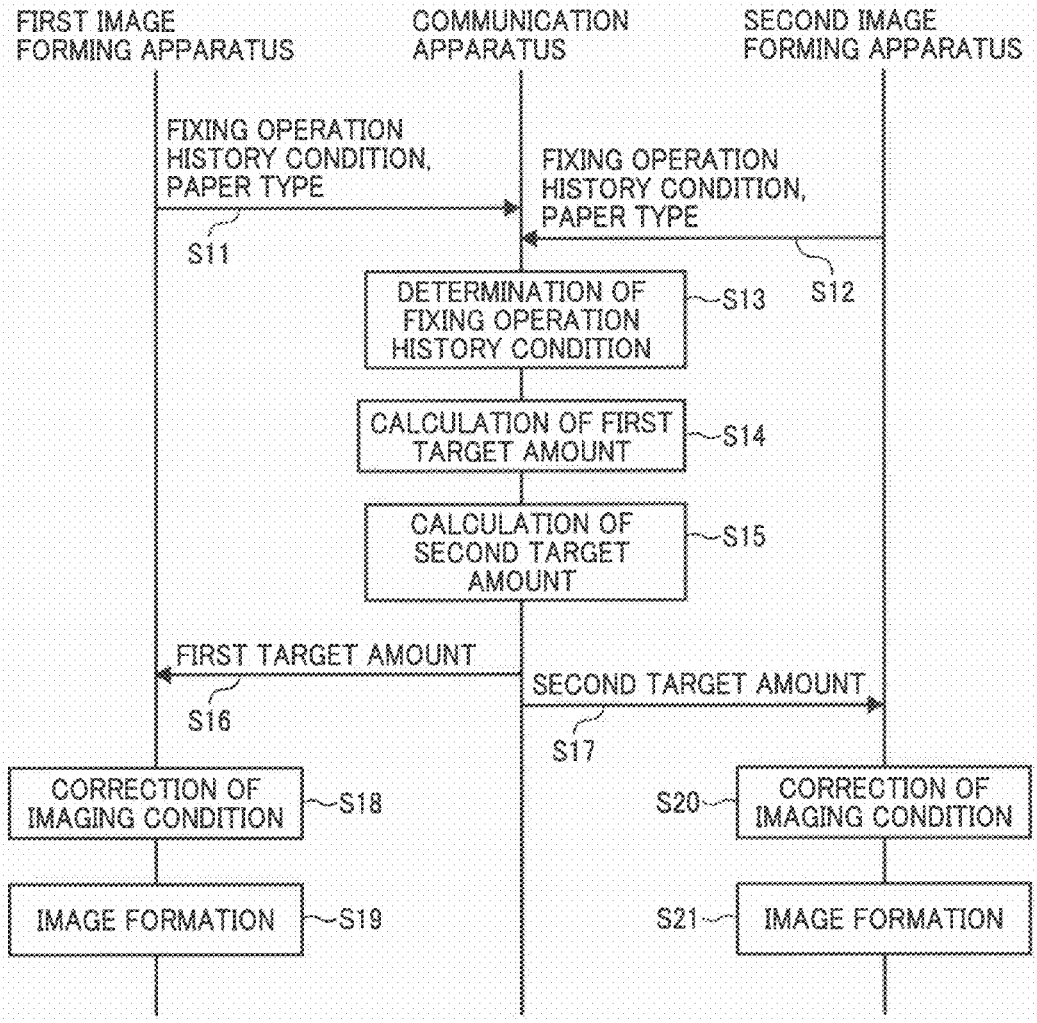
FIG. 5 is a sequence diagram of an image forming operation according to the first embodiment.

Explained below is the image forming operation performed in the image forming system configured in the above-mentioned manner according to the first embodiment. FIG. 5 is a sequence diagram of the image forming operation according to the first embodiment.

Firstly, the communicating unit 430 of each of the first image forming apparatus 1A and the second image forming apparatus 1B sends the corresponding fixing operation history condition and the corresponding paper type to the communication apparatus 80 (Steps S11 and S12).

In the communication apparatus 80, the communicating unit 411 receives each set of the fixing operation history condition and the paper type and, based on the fixing operation history conditions, determines which image forming apparatus would print on the first face (front face) and which image forming apparatus would print on the second face (rear face) (Step S13). In the first embodiment, the first image forming apparatus 1A is determined to print on the first face (front face) and the second image forming apparatus 1B is determined to print on the second face (rear face).

Then, in the communication apparatus 80, the target-deposit-amount determining unit 410 calculates the first target amount that is the target amount of toner deposit with respect to the first image forming apparatus 1A (Step S14) and calculates the second target amount that is the target amount of toner deposit with respect to the second image forming apparatus 1B (Step S15).

Subsequently, the communicating unit 411 of the communication apparatus 80 sends the first target amount to the first image forming apparatus 1A (Step S16) and sends the second target amount to the second image forming apparatus 1B (Step S17).

In the first image forming apparatus 1A, the communicating unit 430 receives the first target amount, and the imaging condition correcting unit 435 corrects the image condition using the first target amount (Step S18) and forms an image (Step S19). Similarly, in the second image forming apparatus 1B, the communicating unit 430 receives the second target amount, and the imaging condition correcting unit 435 corrects the image condition using the second target amount (Step S20) and forms an image (Step S21).

In this way, the communication apparatus 80 obtains, as the transfer rate affecting conditions, the information regarding not only the fixing operation history conditions but also the paper type conditions. Based on that information, the communication apparatus 80 appropriately corrects the first target amount and the second target amount, which are the two target amounts of toner deposit. By performing such correction, the amount of toner deposit on the first face of the web W eventually becomes substantially identical to the amount of toner deposit on the second face of the web W. Hence, it becomes possible to prevent a difference from occurring in image densities on the web W. In the present configuration, without having to transfer the test pattern images that are formed on the photosensitive members 4 onto the web W, it is possible to prevent a difference from occurring in image densities of the two faces of a recording sheet. That spares the user from unintentionally consuming the sheet.

Moreover, in the embodiment, the first image forming apparatus 1A and the second image forming apparatus 1B operate independent to each other, and, as necessary, each image forming apparatus can be set to the single-side printing mode or to the duplex printing mode. Thus, each image forming apparatus can be used either as a dedicated single-side-printing image forming, or as a dedicated first-face-printing image forming apparatus, or as a dedicated second-face-printing image forming apparatus.

Furthermore, in the embodiment, in the case of using a "sheet having fixing history", the amount of toner deposit for a toner image that has been formed on the photosensitive member 4 is increased as compared to the case of using a "sheet having no fixing history". Because of that, the amount of toner deposit for a toner image transferred onto a "sheet having fixing history" can be kept substantially identical to the amount of toner deposit for a toner image transferred onto a "sheet having no fixing history".

Second Embodiment

Figure 6:
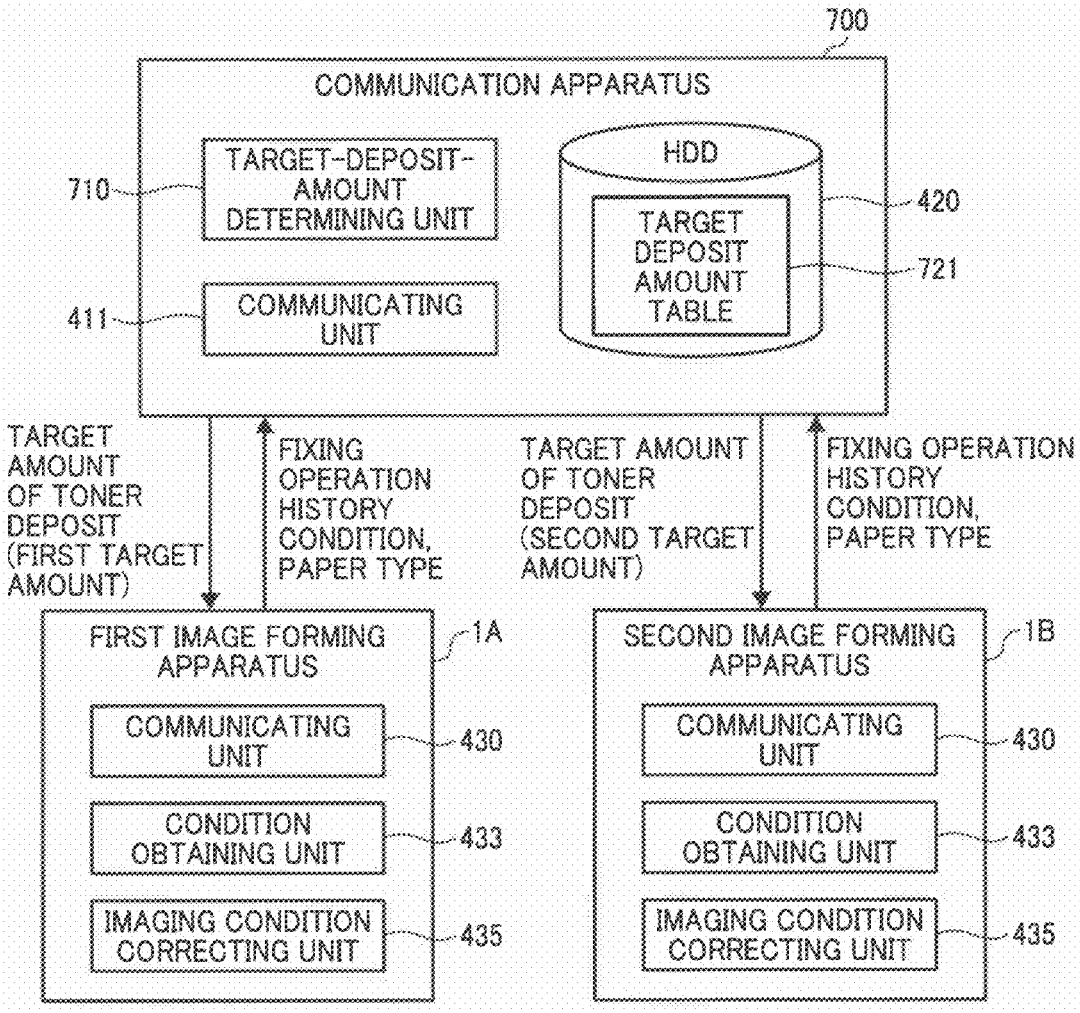
FIG. 6 is a block diagram of a functional configuration of the image forming system according to a second embodiment of the present invention.

FIG. 6 is a block diagram of a functional configuration of the image forming system according to a second embodiment of the present invention. In the embodiment, the configuration and the functions of each of the first image forming apparatus 1A and the second image forming apparatus 1B are identical to that according to the first embodiment.

In the embodiment, as illustrated in FIG. 6, a communication apparatus 700 mainly includes the communicating unit 411, a target-deposit-amount determining unit 710, and the HDD 420. Herein, regarding the communicating unit 411 and the HDD 420, the configuration is identical to that described in the first embodiment.

In the embodiment, a target deposit amount table 721 stored in the HDD 420 is different than the target deposit amount table 421 according to the first embodiment. An example of the target deposit amount table 721 is illustrated in Table 2 given below.

TABLE 2

| | First image forming apparatus 1A | | | | Second image forming apparatus 1B | | | |
|---|---|---|---|---|---|---|---|---|
| No. | Usage mode | Paper type | Toner transfer rate | First target amount of toner deposit | Usage mode | Paper type | Toner transfer rate | Second target amount of toner deposit |
| 1 | Single-side printing | α | t | Tg | Single-side printing | α | t | Tg |
| 2 | First face during duplex printing | | t | Tg | First face during duplex printing | | t | Tg |
| 3 | Second face during duplex printing | | t − 5 | Tg × t/(t − 5) | Second face during duplex printing | | t − 5 | Tg × t/(t − 5) |
| 4 | Single-side printing | γ | t − 3 | Tg × t/(t − 3) | Single-side printing | γ | t − 3 | Tg × t/(t − 3) |
| 5 | First face during duplex printing | | t − 3 | Tg × t/(t − 3) | First face during duplex printing | | t − 3 | Tg × t/(t − 3) |
| 6 | Second face during duplex printing | | t − 7 | Tg × t/(t − 7) | Second face during duplex printing | | t − 7 | Tg × t/(t − 7) |

The target-deposit-amount determining unit 710 determines that the first image forming apparatus 1A that has sent the fixing operation history condition indicating a "sheet having no fixing history" would print on the front face (first face) of the web, and sets the target amount of toner deposit (first target amount) for the first image forming apparatus 1A to an increased amount of toner deposit that is increased based on the toner transfer rate depending on the paper type. Similarly, the target-deposit-amount determining unit 710 determines that the second image forming apparatus 1B that has sent the fixing operation history condition indicating a "sheet having fixing history" would print on the rear face (second face) of the web, and sets the target amount of toner deposit (second target amount) for the second image forming apparatus 1B to an increased amount of toner deposit that is increased based on the toner transfer rate depending on the paper type and that is greater than the target amount of toner deposit (first target amount) for the first image forming apparatus 1A, which has sent the fixing operation history condition indicating a "sheet having no fixing history".

Given below is the detailed explanation of the target-deposit-amount determining unit 710 according to the embodiment. When there is change in the paper type of the web W, the toner transfer rate in each of the first-face-printing image forming apparatus and the second-face-printing image forming apparatus also undergoes a change. Irrespective of a change in the toner transfer rates, the communication apparatus 700 according to the embodiment corrects the target amounts of toner deposit in such a way that a difference is prevented from occurring in image densities of the first face and the second face. However, herein, what is achieved is only the prevention of a difference that may occur in image densities. That is, there still remains a possibility that, in each of the first face and the second face of the web W, a change in the toner transfer rate leads to an increase or a decrease in the image density as compared to the target image density.

In regard to that issue, in the image forming system according to the second embodiment, the standard target deposit amount Tg is corrected according to the paper type in such a way that, irrespective of the paper type, the target image density is achieved in each of the first face and the second face of the web W. More particularly, for a paper type attributed to a lower toner transfer rate, correction is performed from the standard target deposit amount Tg so that a higher amount is obtained.

For example, consider the case of using the web W of the paper type α. In that case, for a toner transfer rate of t[%] with respect to the web W during the single-side printing mode, the toner transfer rate becomes t−5[%] while printing the second face of the web W during the duplex printing mode. Similarly, consider the case of using the web W of a paper type γ. In that case, for a toner transfer rate of t−3[%] with respect to the web W during the single-side printing mode, the toner transfer rate becomes t−7[%] while printing the second face of the web W during the duplex printing mode. It has become clear by prior experiment that differences occur in the toner transfer rate in this way.

At that time, as compared to the single-side printing mode for the paper type α, the toner transfer amount during the single-side printing mode for the paper type γ falls to (t−3)/t [%] and the toner transfer amount during the duplex printing mode for the paper type γ falls to (t−7)/t[%]. Therein, to the first-face-printing image forming apparatus, the communication apparatus 700 sends, as the target amount of toner deposit for the toner image formed on the corresponding photosensitive member 4, an amount obtained by multiplying the standard target deposit amount Tg with "t/(t−3)", which is the reciprocal of "(t−3)/t" in the toner transfer rate. Similarly, to the second-face-printing image forming apparatus, the communication apparatus 700 sends, as the target amount of toner deposit for the toner image formed on the corresponding photosensitive member 4, an amount obtained by multiplying the standard target deposit amount Tg with "t/(t−7)", which is the reciprocal of "(t−7)/t" in the toner transfer rate.

By correcting to "Tg×(t−3)/t" from the standard target deposit amount Tg, the image density on the first face during either the single-side printing mode or the duplex printing mode can be set to the target image density irrespective of the paper type.

Moreover, during the duplex printing mode, by correcting to "Tg×(t−7)/t" from the standard target deposit amount Tg and by using this as the target deposit amount corrected according to the fixing operation history condition and the paper type with the aim of printing the second face during the duplex printing mode, the image density on the second face during the duplex printing mode can be set to the target image density.

Modification Example

In the image forming system according to the abovementioned embodiments, regarding the paper types α, β, and γ of the web W; the relationship between the target deposit amount and the transfer rate affecting conditions (paper type and/or fixing operation history condition) as illustrated in Table 1 or Table 2 is stored in advance in the HDD 420 of the communication apparatus 80 or the communication apparatus 700. However, in those embodiments, if a new paper type δ for the web W is introduced in the market, then it is not possible to deal with that web W.

Regarding that issue, in the image forming system according to the present modification example, the communication apparatus 80 is configured to include an input unit such as a numerical keypad for the purpose of inputting the relationship between the transfer rate affecting condition and the first target amount or the second target amount, such as using the target deposit amount of "Tg×(t−15)/t" for printing the first face of the paper type δ during the duplex printing mode. That makes it possible to deal new paper types. Moreover, as a correction factor of the paper type δ, it is also possible to input a coefficient for correction from the standard target deposit amount Tg. Hence, even when the paper type δ is used, the target image density can be achieved in each of the first face and the second face.

In this way, in the image forming system according to the present modification example, the communication apparatus 80 is configured to include an input unit for the purpose of inputting the relationship of the transfer rate affecting condition with the first target amount or the second target amount. For that reason, even when a new paper type is introduced in the market, it becomes possible to deal with that paper type by inputting the abovementioned relationship regarding the new paper type.

Third Embodiment

Figure 7:
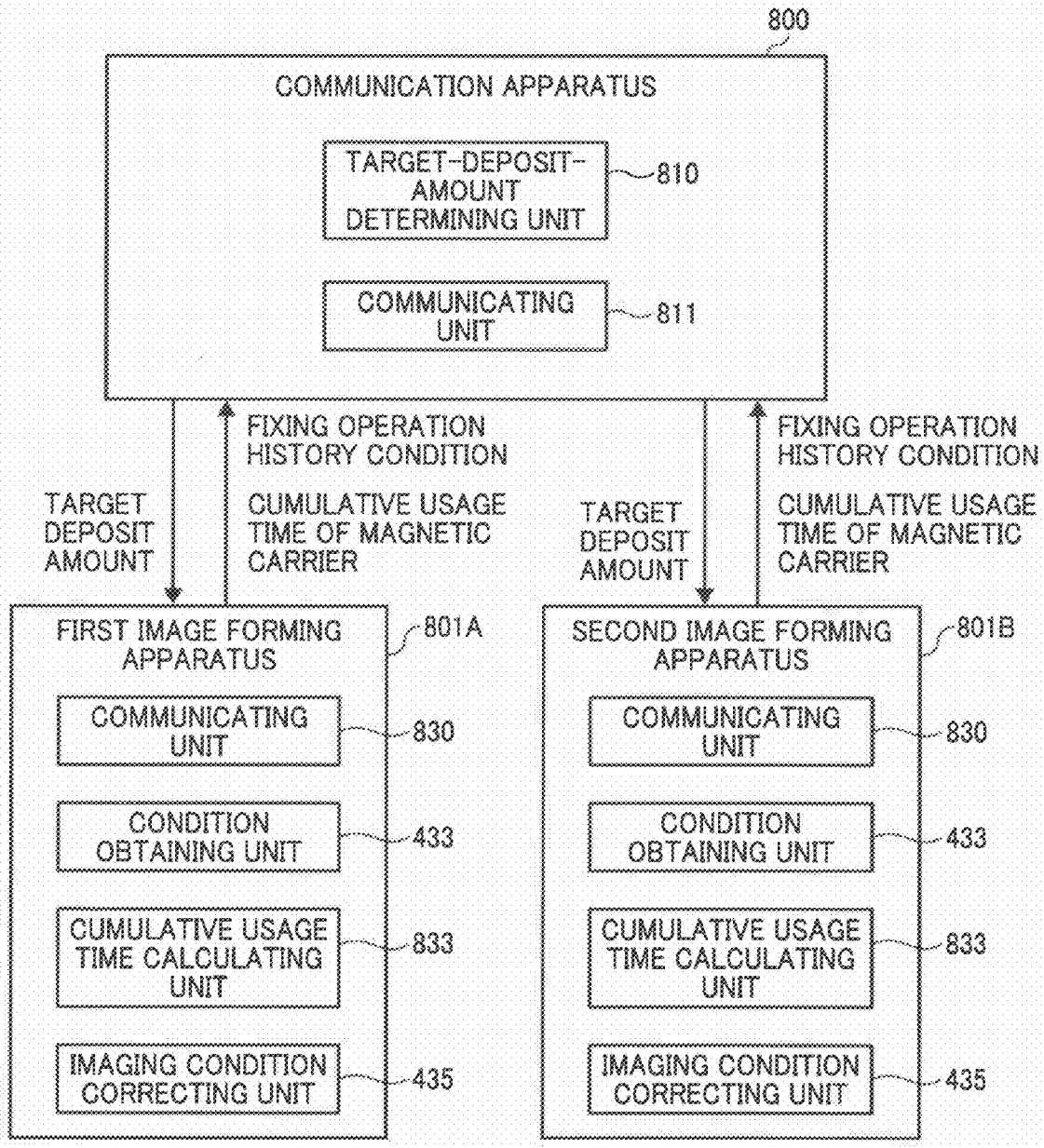
FIG. 7 is a functional block diagram of the image forming system according to a third embodiment of the present invention.

FIG. 7 is a functional block diagram of the image forming system according to a third embodiment of the present invention. As illustrated in FIG. 7, according to the embodiment, a communication apparatus 800 includes a communicating unit 811 and a target-deposit-amount determining unit 810.

From each of a first image forming apparatus 801A and a second image forming apparatus 801B, the communicating unit 811 receives the transfer rate affecting condition and a cumulative usage time of the magnetic carrier.

With respect to each of the first image forming apparatus 801A and the second image forming apparatus 801B, the target-deposit-amount determining unit 810 determines the target deposit amount (the first target amount or the second target amount) in such a way that the target deposit amount is increased with an increase of the length of the cumulative usage time of the corresponding magnetic carrier.

Each of the first image forming apparatus 801A and the second image forming apparatus 801B mainly includes a communicating unit 830, the condition obtaining unit 433, a cumulative usage time calculating unit 833, and the imaging condition correcting unit 435. Herein, regarding the condition obtaining unit 433 and the imaging condition correcting unit 435, the configuration is identical to that described in the first embodiment.

Each communicating unit 830 sends the corresponding fixing operation history condition and the cumulative usage time of the corresponding magnetic carrier to the communication apparatus 800. Besides, in an identical manner to the first two embodiments, each communicating unit 830 receives the corresponding target amount of toner deposit (the first target amount or the second target amount) from the communication apparatus 800.

Given below is the detailed explanation of the target-deposit-amount determining unit 810 according to the embodiment. It is already stated that, when the web W is a "sheet having fixing history", the toner transfer rate decreases as compared to a "sheet having no fixing history". In order to partly prevent the decrease in the toner transfer rate, the web W of a particular kind can be used that prevents the occurrence of wrinkles that may be formed due to water evaporation. However, there are times when the toner transfer rate falls due to reasons other than the formation of small wrinkles on the paper surface.

More particularly, in the image forming system according to the third embodiment, with the aim of reducing the scumming effect that tends to take place with an increase in the cumulative usage time of the magnetic carrier in the developer, the configuration is such that a control target level of toner concentration gradually falls down with an increase in the cumulative usage time of the magnetic carrier. In this configuration, it was found that with a gradual decrease in the control target level of toner concentration, the toner transfer rate also decreases in a gradual manner. Hence, if the cumulative usage time of the magnetic carrier in the first image forming apparatus 801A is largely different than the cumulative usage time of the magnetic carrier in the second image forming apparatus 801B, then the control target levels of the toner concentration differ by a large margin thereby leading to a large difference in the toner transfer rates in the two image forming apparatuses.

Figure 8:
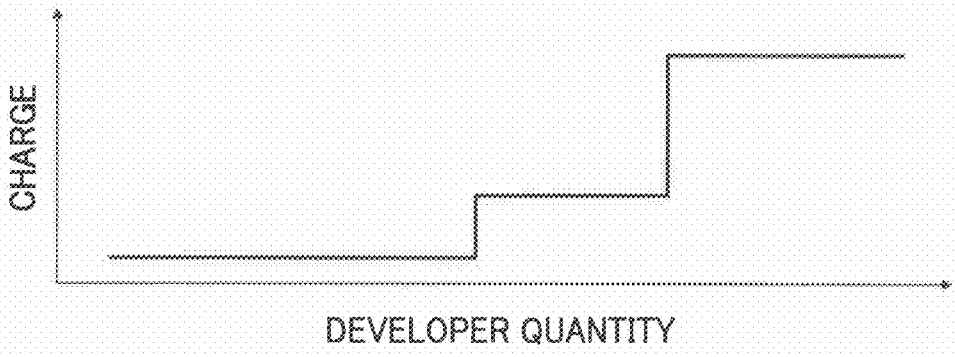
FIG. 8 is a graph illustrating a relationship between the cumulative usage time of a magnetic carrier and the absolute value of the average toner charge.

FIG. 8 is a graph illustrating a relationship between the cumulative usage time of the magnetic carrier in one of the developing units 7 in the image forming system according to the third embodiment and the average toner charge (absolute value). When the cumulative usage time of the magnetic carrier increases to some extent and is accompanied by a decrease in the control target level of toner concentration, the magnetic carrier particles and the toner particles undergo sliding friction in a more active manner as the toner concentration decrease by larger amount. Consequently, as illustrated in the graph in FIG. 8, a decrease in the control target level of toner concentration is accompanied by an increase in the average toner charge. In the example given in FIG. 8, it is illustrated that the control target level of toner concentration is corrected twice over time and that the average toner charge inside the developing unit increases at each time of correction. When the average toner charge increases, the toner transfer rate falls by a margin corresponding to the increase in the average toner charge.

In regard to that issue, in the image forming system according to the embodiment, instead of obtaining the information regarding the fixing operation history conditions, the communication apparatus 800 is configured to obtain the information regarding either the cumulative usage time of the magnetic carriers or the control target levels of toner concentration so as to enable correction in the target amounts of toner deposit based on that information. As the cumulative usage time of each magnetic carrier, the communication apparatus 800 can be configured to calculate the cumulative operating time of the corresponding developing unit since the time of receiving information that indicates implement of replacement of that magnetic carrier (or that developing unit) from the user. In this case, by calculating the cumulative usage time of the magnetic carriers, the communication apparatus 800 indirectly obtain the control target levels of toner concentration. Thus, in the image forming system according to the embodiment, the information regarding the cumulative usage time of the magnetic carriers can be considered synonymous with the information regarding the control target levels of toner concentration.

Figure 9:
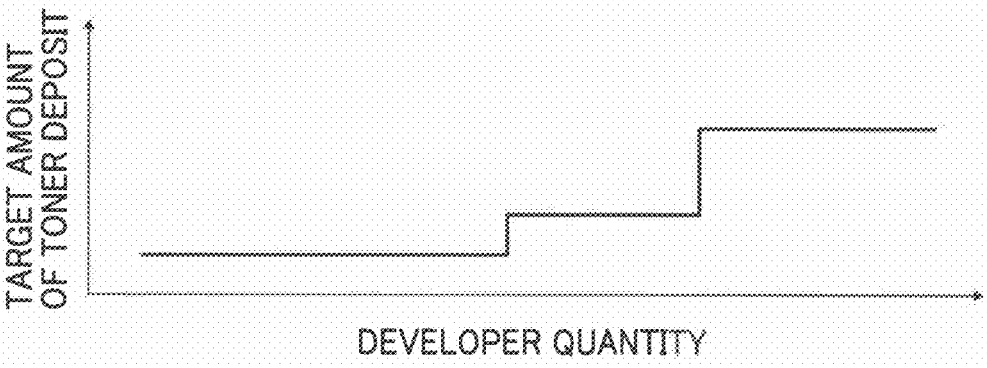
FIG. 9 is a graph illustrating a relationship between the cumulative usage time and the appropriate amount of toner deposit.

FIG. 9 is a graph illustrating the relationship between the cumulative usage time of the magnetic carrier (or the amount of decrease in the control target level of toner concentration) and the appropriate amount of toner deposit, which represents that amount of toner deposit for a toner image formed on the surface of the photosensitive member 4 which enables achieving the target image density when the toner transfer rate has a value reached under the conditions of the cumulative usage time of the magnetic carrier. As illustrated in FIG. 9, as the cumulative usage time of the magnetic carrier increases, the appropriate amount of toner deposit also increases in a stepwise fashion. That appropriate amount of toner deposit enables achieving the target image density. That is because, as illustrated in FIG. 9, with the increase in the cumulative usage time of the magnetic carrier, the control target level of toner concentration falls down in a stepwise fashion and, at each step, the toner transfer rate also goes on decreasing.

The communication apparatus 800 stores therein the graph illustrated in FIG. 9 or the corresponding algorithm. Then, regarding each of the first-face-printing first image forming apparatus 801A and the second-face-printing second image forming apparatus 801B, the communication apparatus specifies the appropriate amount of toner deposit based on the cumulative usage time of the corresponding magnetic carrier and also based on the graph illustrated in FIG. 9 or the corresponding algorithm, and sends each specification result as the target deposit amount to the corresponding image forming apparatus. In each image forming apparatus, the appropriate amount of toner deposit corresponding to the cumulative usage time of the magnetic carrier is considered to be the target deposit amount. Thus, among the image forming apparatuses, the amounts of toner deposit are set to have a difference equivalent to the difference in the toner transfer rates. Hence, among the image forming apparatuses, it becomes possible to prevent a difference from occurring in image densities, which may occur due to the difference in the cumulative usage time of the magnetic carriers.

Figure 10:
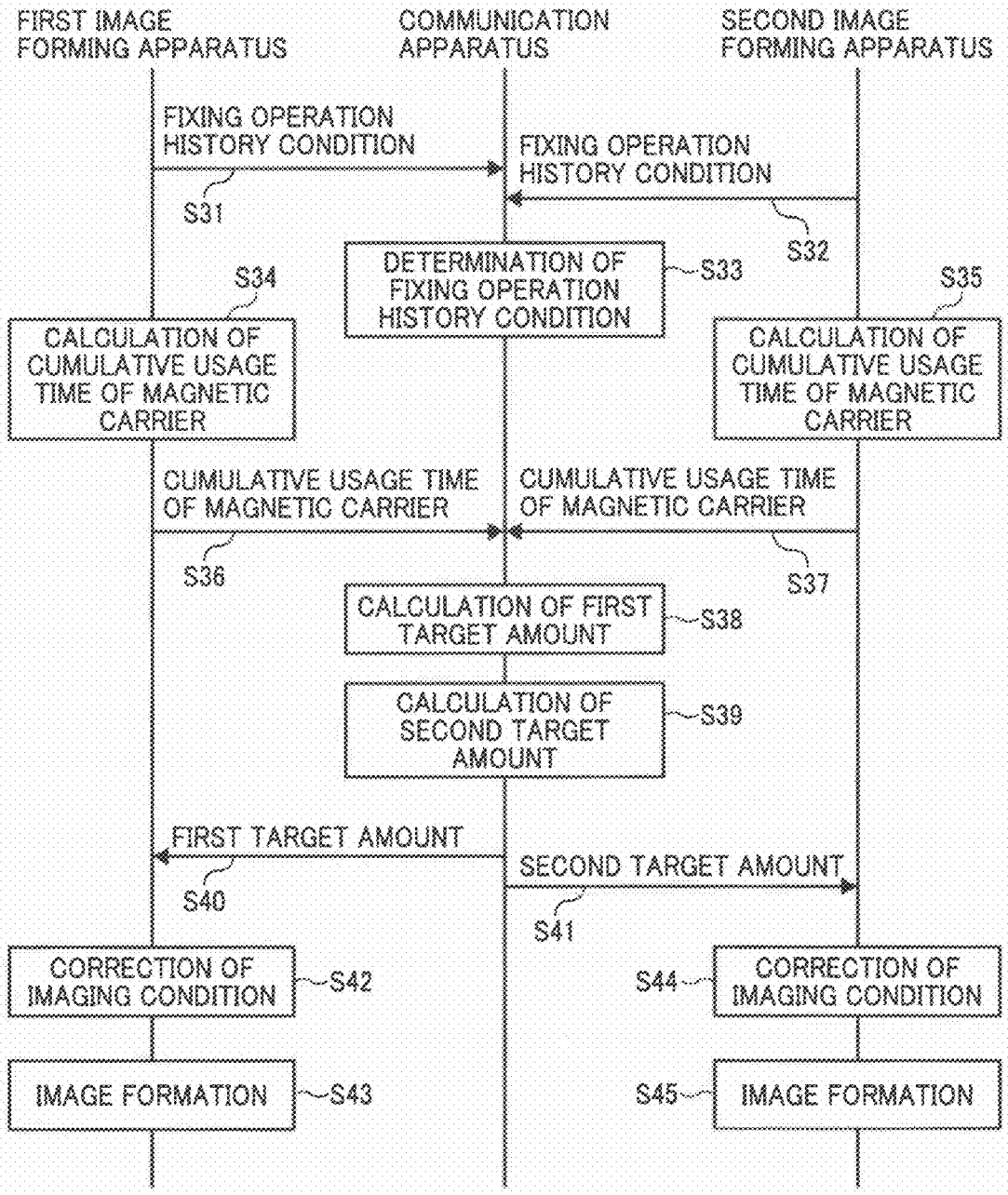
FIG. 10 is a sequence diagram of an image forming operation according to the third embodiment.

Explained below is the image forming operation performed in the image forming system configured in the above-mentioned manner according to the embodiment. FIG. 10 is a sequence diagram of the image forming operation according to the third embodiment.

Firstly, the communication unit 830 of each of the first image forming apparatus 801A and the second image forming apparatus 801B sends the corresponding fixing operation history condition to the communication apparatus 800 (Steps S31 and S32).

In the communication apparatus 800, the communicating unit 811 receives each fixing operation history condition and, based on the fixing operation history conditions, determines which image forming apparatus would print on the first face (front face) and which image forming apparatus would print on the second face (rear face) (Step S33). In the third embodiment, the first image forming apparatus 801A is determined to print on the first face (front face) and the second image forming apparatus 801B is determined to print on the second face (rear face).

Subsequently, the cumulative usage time calculating unit 833 of each of the first image forming apparatus 801A and the second image forming apparatus 801B calculates the cumulative usage time of the corresponding magnetic carrier (Steps S34 and S35). Then, the communicating unit 830 of each of the first image forming apparatus 801A and the second image forming apparatus 801B sends the cumulative usage time of the corresponding magnetic carrier to the communication apparatus 800 (Steps S36 and S37).

In the communication apparatus 800, the target-deposit-amount determining unit 810 makes use of the relationship illustrated in FIG. 9 and calculates the first target amount that is the target amount of toner deposit for the first image forming apparatus 801A so as to be larger as the length of the cumulative usage time of the corresponding magnetic carrier is larger (Step S38). Similarly, the target-deposit-amount determining unit 810 calculates the second target amount that is the target amount of toner deposit for the second image forming apparatus 801B so as to be larger as the length of the cumulative usage time of the corresponding magnetic carrier is larger (Step S39).

Subsequently, the communicating unit 811 of the communication apparatus 800 sends the calculated first target amount to the first image forming apparatus 801A (Step S40) and sends the calculated second target amount to the second image forming apparatus 801B (Step S41).

Then, in an identical manner to the first embodiment, the first image forming apparatus 801A and the second image forming apparatus 801B respectively receive the first target amount and the second target amount, correct the respective imaging conditions, and form images (Steps S42 to S45).

In this way, according to the embodiment, even if a difference exists in the toner transfer rates due to different control target conditions for toner concentration, the target deposit amounts for the first face and the second face can be corrected to have a difference corresponding to the difference in the toner transfer rates. As a result, it becomes possible to achieve the same amount of toner deposit for the first face and the second face.

Moreover, according to the embodiment, a decrease in the toner transfer amount, which is attributed to a decrease in the toner transfer rate accompanying a decrease in the toner concentration, can be compensated by increasing the amount of toner deposit for a toner image formed on the photosensitive member 4. That makes it possible to bring the image density on the paper surface closer to the target image density.

Meanwhile, instead of using only the cumulative usage time of the magnetic carrier to determine the appropriate amount of toner deposit, it is also possible to make use of a combination of that cumulative usage time and the fixing operation history information. With that, it not only becomes possible to prevent a difference from occurring in image densities, which may occur due to the difference in the toner transfer rates in the image forming apparatuses depending on the presence or absence of the fixing operation history of the web W, but also becomes possible to prevent a difference from occurring in image densities, which may occur due to the difference in the toner transfer rates in the image forming apparatuses depending on the difference in the cumulative usage time of the respective magnetic carriers.

In this way, according to an aspect of the present invention, it is possible to reduce the difference occurring between the image density of a toner image formed on the first face and the image density of a toner image formed on the second face of a continuous recording paper, without forcing the user to unintentionally consume the continuous recording paper.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming system comprising:

two image forming apparatuses, each forming an image on one of a first face and a second face serving as image forming faces of a continuous recording paper; and a control apparatus connected to the two image forming apparatuses, wherein the control apparatus includes a receiving unit that receives, from each of the two image forming apparatuses, information regarding a transfer rate affecting condition that affects a difference in toner transfer rates of the image forming faces;

a determining unit that determines, based on a standard amount of toner deposit and the transfer rate affecting condition regarding each of the first face and the second face, a target deposit amount representing a target amount of toner deposit in each of the two image forming apparatuses in such a way that the target deposit amounts have a difference corresponding to the difference in the toner transfer rate between the two image forming apparatuses; and a sending unit that sends the target deposit amounts to the two image forming apparatuses, and each of the two image forming apparatuses includes a communicating unit that sends the corresponding transfer rate affecting condition to the control apparatus and receives the corresponding target deposit amount from the control apparatus;

an imaging condition correcting unit that corrects an imaging condition based on the corresponding target deposit amount; and an image forming unit that forms an image based on the corrected imaging condition.

2. The image forming system according to claim 1, wherein as the transfer rate affecting condition, the communicating unit sends to the control apparatus a fixing operation history condition indicating whether the continuous recording paper has been subjected to a fixing operation, the receiving unit receives the fixing operation history condition from each of the two image forming apparatuses, and for the image forming apparatus that has sent the fixing operation history condition indicating no execution of the fixing operation, the determining unit sets the target deposit amount to the standard amount of toner deposit, and for the image forming apparatus that has sent the fixing operation history condition indicating prior execution of the fixing operation, the determining unit sets the target deposit amount to an amount that is corrected from the standard amount of toner deposit based on the toner transfer rate.

3. The image forming system according to claim 2, wherein the communicating unit also sends to the control apparatus a paper type of the continuous recording paper to be used in the two image forming apparatuses, the receiving unit receives the paper type from each of the two image forming apparatuses, and for the image forming apparatus that has sent the fixing operation history condition indicating no execution of the fixing operation, the determining unit sets the target deposit amount to the standard amount of toner deposit, and for the image forming apparatus that has sent the fixing operation history condition indicating prior execution of the fixing operation, the determining unit sets the target deposit amount to an amount that is corrected from the standard amount of toner deposit based on the toner transfer rate depending on the paper type.

4. The image forming system according to claim 3, wherein to the control apparatus, the communicating unit sends the fixing operation history condition as the transfer rate affecting condition that indicates whether the continuous recording paper has been subjected to a fixing operation and sends the paper type of the continuous recording paper to be used in the two image forming apparatuses, the receiving unit receives the paper type and the fixing operation history condition from each of the two image forming apparatuses, and for the image forming apparatus that has sent the fixing operation history condition indicating no execution of the fixing operation, the determining unit sets the target deposit amount to an amount that is corrected based on the toner transfer rate depending on the paper type, and for the image forming apparatus that has sent the fixing operation history condition indicating prior execution of the fixing operation, the determining unit sets the target deposit amount to an amount that is corrected based on the toner transfer rate depending on the paper type.

5. The image forming system according to claim 4, wherein, for the image forming apparatus that has sent the fixing operation history condition indicating no execution of the fixing operation, the determining unit sets the target deposit amount to an amount that is increased based on the toner transfer rate depending on the paper type, and for the image forming apparatus that has sent the fixing operation history condition indicating prior execution of the fixing operation, the determining unit sets the target deposit amount to an amount that is increased based on the toner transfer rate depending on the paper type and that is greater than the target deposit amount determined for the image forming apparatus that has sent the fixing operation history condition indicating no execution of the fixing operation.

6. The image forming system according to claim 1, wherein the communicating unit sends to the control apparatus a cumulative usage time of a magnetic carrier, the receiving unit receives the cumulative usage time from each of the two image forming apparatuses, and for each of the two image forming apparatuses, the determining unit sets the target deposit amount based on the corresponding cumulative usage time.

7. The image forming system according to claim 6, wherein, for each of the two image forming apparatuses, the determining unit sets the target deposit amount so as to be larger as the length of the corresponding cumulative usage time is larger.

8. The image forming system according to claim 1, wherein the control apparatus further includes an input unit that receives input of the transfer rate affecting condition from a user, and the determining unit sets the target deposit amount based on the standard amount of toner deposit and based on the transfer rate affecting condition that has been input.

9. A control apparatus connected to two image forming apparatuses each forming an image on one of a first face and a second face serving as image forming faces of a continuous recording paper, the control apparatus comprising:

a receiving unit that receives, from each of the two image forming apparatuses, information regarding a transfer rate affecting condition that affects a difference in toner transfer rates of the image forming faces;

a determining unit that determines, based on a standard amount of toner deposit and the transfer rate affecting condition regarding each of the first face and the second face, a target deposit amount representing a target amount of toner deposit in each of the two image forming apparatuses in such a way that the target deposit amounts have a difference corresponding to the difference in the toner transfer rate between the two image forming apparatuses; and a sending unit that sends the target deposit amounts to the two image forming apparatuses.

10. The control apparatus according to claim 9, wherein from each of the two image forming apparatuses, the receiving unit receives a fixing operation history condition as the transfer rate affecting condition that indicates whether the continuous recording paper has been subjected to a fixing operation, for the image forming apparatus that has sent the fixing operation history condition indicating no execution of the fixing operation, the determining unit sets the target deposit amount to the standard amount of toner deposit, and for the image forming apparatus that has sent the fixing operation history condition indicating prior execution of the fixing operation, the determining unit sets the target deposit amount to an amount that is corrected from the standard amount of toner deposit based on the toner transfer rate.

11. The control apparatus according to claim 10, wherein from each of the two image forming apparatuses, the receiving unit receives a paper type of the continuous recording paper to be used in the two image forming apparatuses, and for the image forming apparatus that has sent the fixing operation history condition indicating no execution of the fixing operation, the determining unit sets the target deposit amount to the standard amount of toner deposit, and for the image forming apparatus that has sent the fixing operation history condition indicating prior execution of the fixing operation, the determining unit sets the target deposit amount to an amount that is corrected from the standard amount of toner deposit based on the toner transfer rate depending on the paper type.

12. The control apparatus according to claim 11, wherein from each of the two image forming apparatuses, the receiving unit receives the fixing operation history condition as the transfer rate affecting condition that indicates whether the continuous recording paper has been subjected to a fixing operation and receives the paper type of the continuous recording paper to be used in the two image forming apparatuses, and for the image forming apparatus that has sent the fixing operation history condition indicating no execution of the fixing operation, the determining unit sets the target deposit amount to an amount that is corrected based on the toner transfer rate depending on the paper type, and for the image forming apparatus that has sent the fixing operation history condition indicating prior execution of the fixing operation, the determining unit sets the target deposit amount to an amount that is corrected based on the toner transfer rate depending on the paper type.

13. The control apparatus according to claim 12, wherein, for the image forming apparatus that has sent the fixing operation history condition indicating no execution of the fixing operation, the determining unit sets the target deposit amount to an amount that is increased based on the toner transfer rate depending on the paper type, and for the image forming apparatus that has sent the fixing operation history condition indicating prior execution of the fixing operation, the determining unit sets the target deposit amount to an amount that is increased based on the toner transfer rate depending on the paper type and that is greater than the target deposit amount determined for the image forming apparatus that has sent the fixing operation history condition indicating no execution of the fixing operation.

14. The control apparatus according to claim 9, wherein from each of the two image forming apparatuses, the receiving unit receives a cumulative usage time of a magnetic carrier, and for each of the two image forming apparatuses, the determining unit sets the target deposit amount based on the corresponding cumulative usage time.

15. The control apparatus according to claim 14, wherein, for each of the two image forming apparatuses, the determining unit sets the target deposit amount so as to be larger as the length of the corresponding cumulative usage time is larger.

16. The control apparatus according to claim 9, further comprising an input unit that receives input of the transfer rate affecting condition from a user, wherein the determining unit sets the target deposit amount based on the standard amount of toner deposit and based on the transfer rate affecting condition that has been input.

17. An image forming apparatus that is connected to a control apparatus and that forms an image on a second face from among a first face and a second face serving as image forming faces of a continuous recording paper, the image forming apparatus comprising:

a sending unit that sends, to the control apparatus, a transfer rate affecting condition that affects a difference in toner transfer rates of the first face and the second face;

a receiving unit that receives, from the control apparatus, a target deposit amount that is determined by the control apparatus based on a standard amount of toner deposit and the transfer rate affecting condition regarding each of the first face and the second face and that is determined as a target amount of toner deposit in the image forming apparatus and has a difference corresponding to the difference in the toner transfer rates in the image forming apparatus and another image forming apparatus that forms an image on the first face;

an imaging condition correcting unit that corrects an imaging condition based on the target deposit amount; and an image forming unit that forms an image based on the corrected imaging condition.

* * * * *